US006091916A

United States Patent [19]

Dycher

[11] Patent Number: 6,091,916

[45] Date of Patent: Jul. 18, 2000

[54] RETRACTABLE SHIELD FOR A PHOTOSENSITIVE MEMBER

[75] Inventor: David Keith Dycher, Port Erin, United Kingdom

[73] Assignee: GCC Management Limited, Kowloon, The Hong Kong Special Administrative Region of the People's Republic of China

[21] Appl. No.: 09/313,372

[22] Filed: May 18, 1999

[30] Foreign Application Priority Data

May 22, 1998 [GB] United Kingdom ..... 9811166

[51] Int. Cl.[7] ..... G03G 21/18

[52] U.S. Cl. ..... 399/114

[58] Field of Search ..... 399/111, 114

[56] References Cited

U.S. PATENT DOCUMENTS 4,327,992 5/1982 Babicz .
4,462,677 7/1984 Onoda .
4,470,689 9/1984 Nomura et al. .
4,538,896 9/1985 Tajima et al. .
4,737,817 4/1988 Kando et al. ..... 399/114
5,231,453 7/1993 Nakai et al. ..... 399/114

FOREIGN PATENT DOCUMENTS 0247602 12/1987 European Pat. Off. .
2101903 1/1983 United Kingdom .

OTHER PUBLICATIONS

British Search Report.

*Primary Examiner*—William J. Royer
*Attorney, Agent, or Firm*—Liniak, Berenato, Longacre & White, LLC

[57] ABSTRACT

An electrophotographic image forming apparatus includes a removably mounted process unit containing a photosensitive member and process units. A movable cover is connected to the process unit and shields an area of a periphery of the photosensitive member. The movable cover is caused to retract from its shielding position in response to rotational movement of the photosensitive member.

23 Claims, 9 Drawing Sheets

RETRACTABLE SHIELD FOR A PHOTOSENSITIVE MEMBER

This application claims priority from Great Britain Patent Application No. 9811166.9, filed on May 22, 1998.

The present invention relates to an electrophotographic process unit, including a photosensitive member and process means, detachably mounted in an apparatus for forming images.

The concept of a removable process unit was disclosed in U.S. Pat. No. 4,327,992 which discloses a copying apparatus in which the serviceable parts, including a photosensitive member and a developer unit, are mounted on a drawer frame which can be easily withdrawn from the main unit in order that service of the consumable parts might take place.

U.S. Pat. No. 4,538,896 discloses a process unit which is removable from the main image forming unit and is intended to be discarded. This allows the user to perform a preventive maintenance task without specialised assistance from a Service Technician.

GB 2,101,903 discloses a user removable process unit fitted with a cover to shield the photosensitive member. This cover is movable between two positions; the first to expose the photosensitive member for the purposes of image transfer and the second to shield it. Acknowledging that the user is handling a sensitive part of the apparatus and may wish to re-install it at a later date for the purposes of colour changing or clearing a paper jam, the disclosure seeks to provide protection for the photosensitive drum when the process unit is in unskilled hands.

U.S. Pat. No. 4,462,677 discloses a cover which is actuated by the opening of the paper path such as in a clam shell copier arrangement.

U.S. Pat. No. 4,470,689 discloses a cover which is actuated by the removal of the process unit from the image forming apparatus.

Embodiments of the latter 3 inventions require an actuating system which is not part of the image forming mechanism to effect the opening or closing of the drum cover. Furthermore the embodiments described require that a space is provided around the periphery of the process unit to allow for the opening of the cover. This space increases the necessary volume required by the process unit within the image forming apparatus and the opened cover may also interfere with the airflow around the process unit.

The present invention utilises the movement of one or more elements of the image forming process to actuate the opening of a drum cover.

Another aspect of the invention is to provide a space within the external walls of the process unit into which the cover can withdraw.

Thus the design of the image forming apparatus can be simplified because no dedicated mechanical actuator needs to be provided other than the image forming elements of the machine. This allows for economies both in materials and labour. Furthermore, due to the internalisation of the withdrawn cover, the space required by the process unit within the image forming apparatus is reduced and the airflow around the process unit can be improved.

To improve the compactness of the system still further, disclosure is made of a multi section cover whereby sections can move relative to one another during the retraction process and so reduce the length of housing required to accomodate the cover.

Also disclosed is a flexible cover which might fold or ripple in the retracted state to reduce the amount of space required to house it.

The invention will now be further described by way of example with reference to the accompanying drawings in which.

Figure 3A:
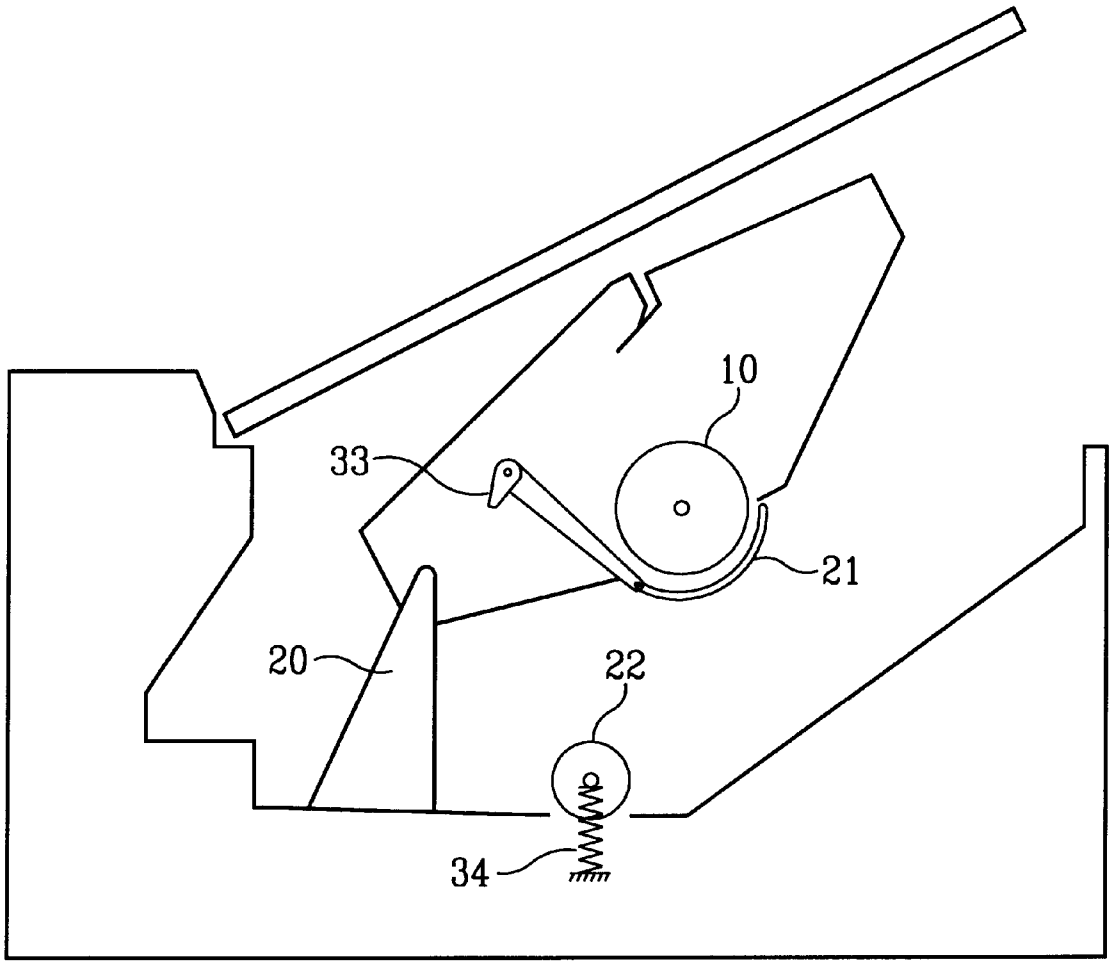
Fig. 3A Prior Art
Figure 3B:
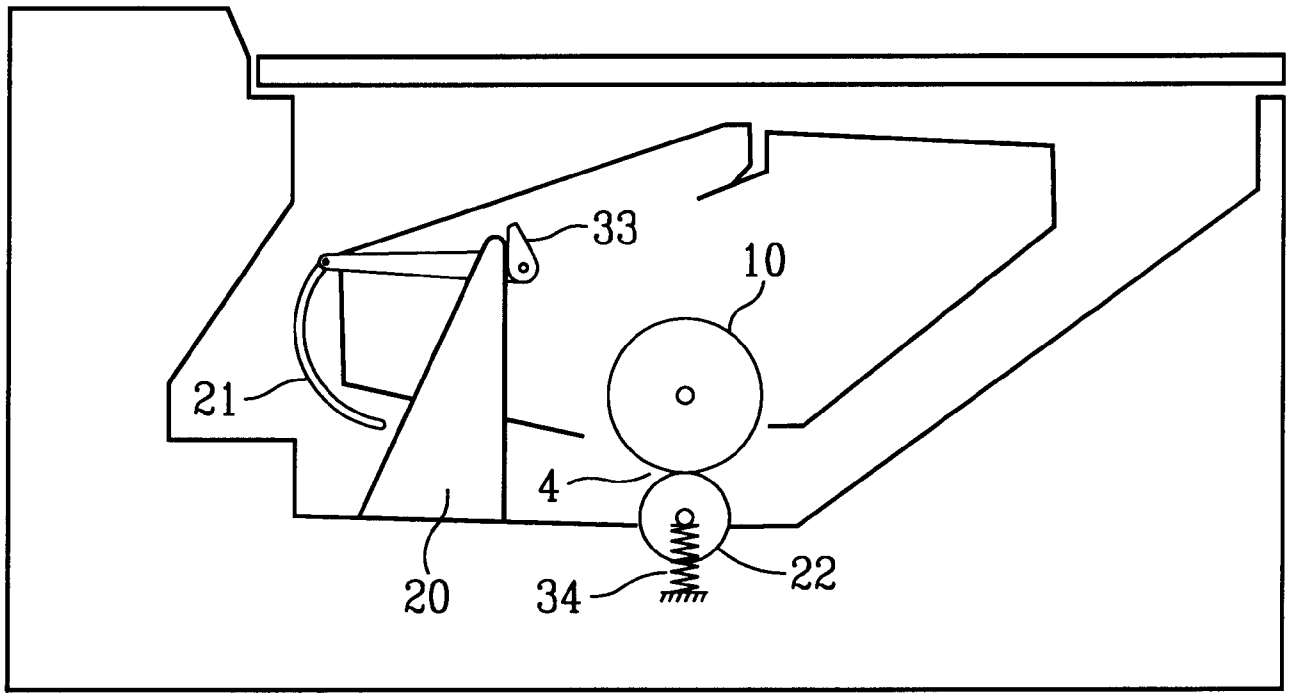
Fig. 3B Prior Art

FIGS. 3A and 3B show an image forming apparatus (laser beam printer) whereby an actuator causes the drum cover to move into an open position when the process unit is inserted into the machine. FIG. 3A shows the process unit prior to installation and FIG. 3B shows the process unit installed inside the main body of the apparatus with the drum cover in the open position. This forms another aspect of the prior art.

Figure 4A:
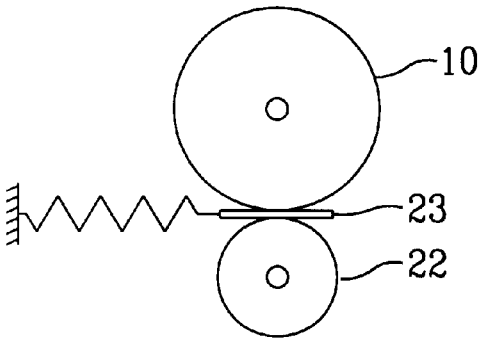
Figure 4B:
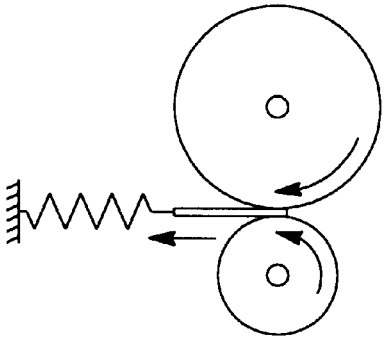
Figure 4C:
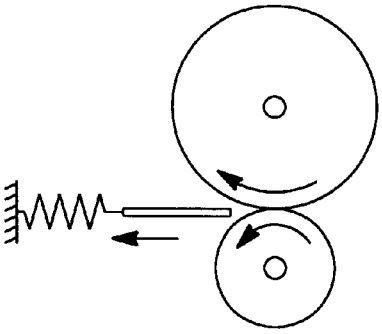

FIGS. 4A, 4B and 4C illustrate the principle of utilising the rotation of the Photosensitive Drum and/or Transfer Roller to move the drum cover.

Figure 5B:
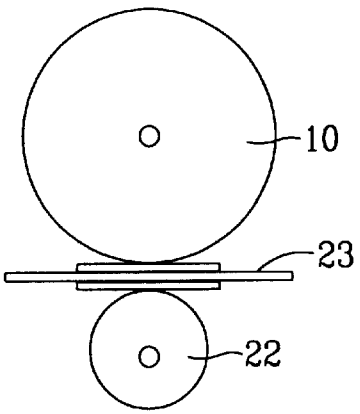
Figure 5A:
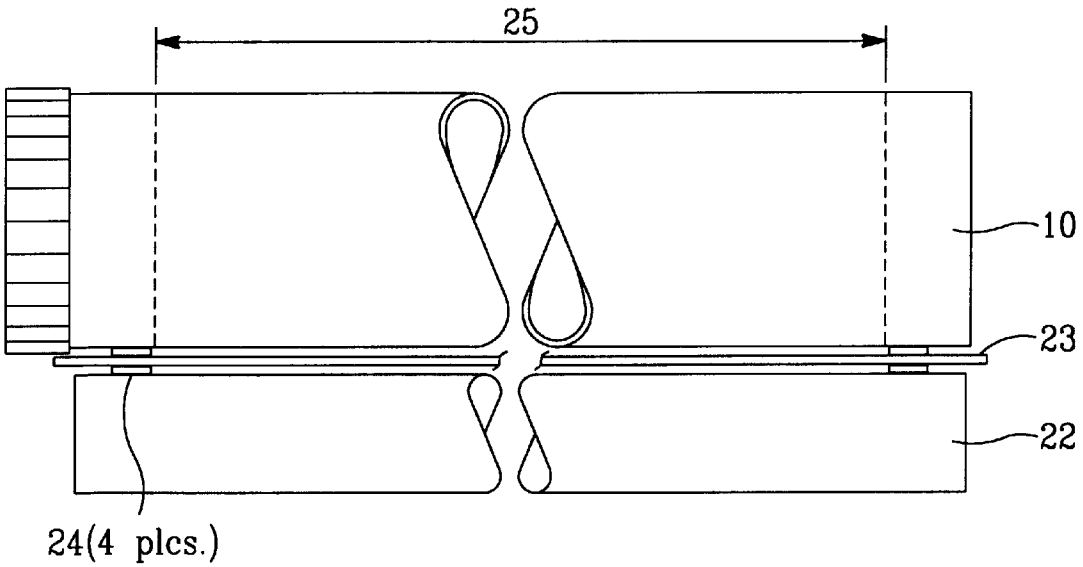

FIGS. 5A and 5B show front (5A) and side (5B) schematics of an arrangement whereby spacers are employed outside the area corresponding to the image area on the Photosensitive Drum.

Figure 6A:
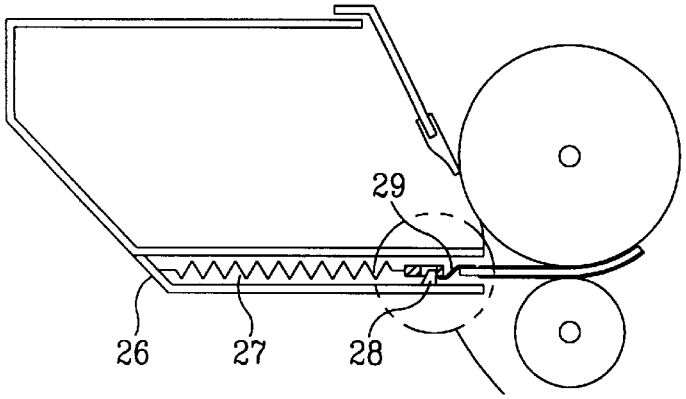
Figure 6D:
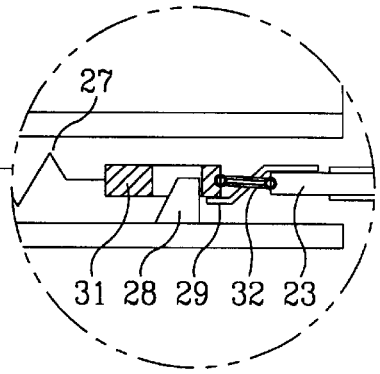
Figure 6B:
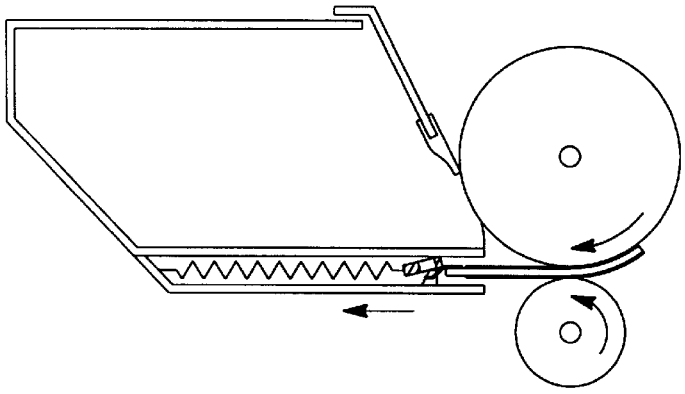
Figure 6C:
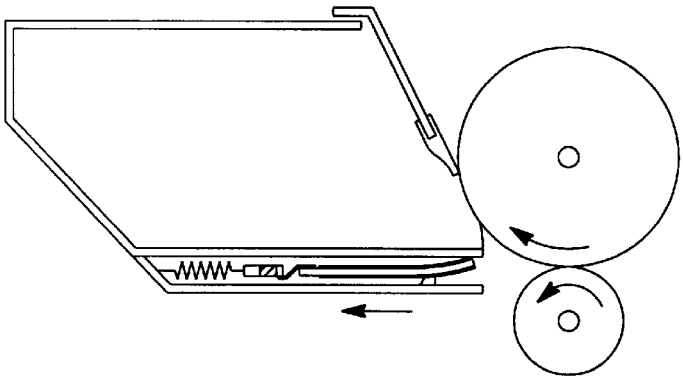

FIGS. 6A, 6B and 6C show a detailed arrangement of the preferred embodiment including an integral receiving area for the withdrawn cover. FIGS. 6A, 6B and 6C show the cover before activation, at the unlatching point and in the fully retracted position respectively.

Figure 7A:
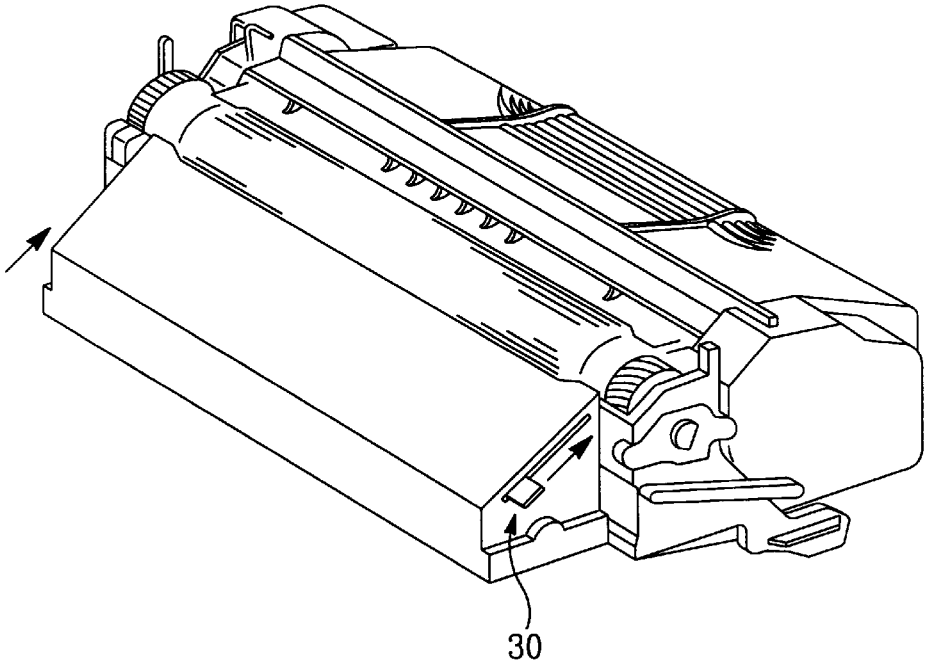
Figure 7B:
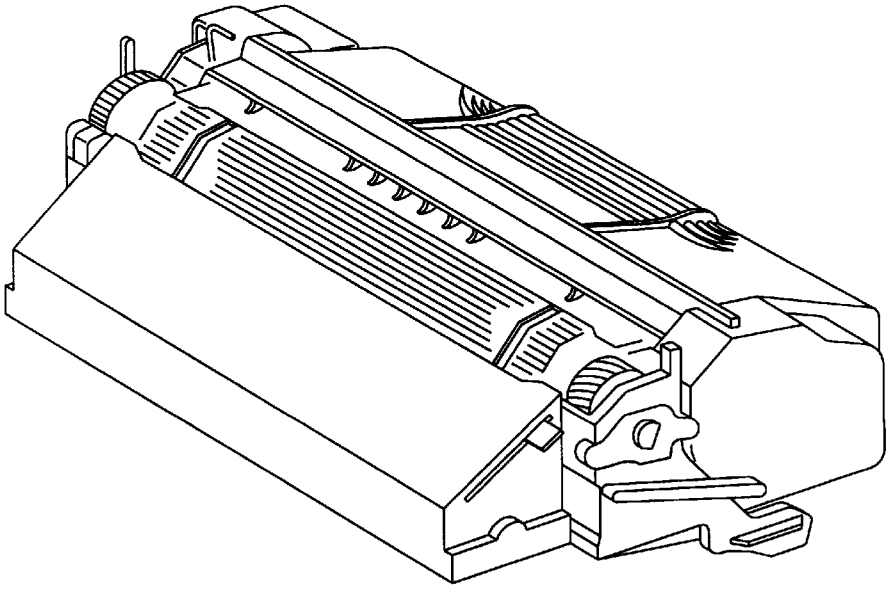

FIGS. 7A and 7B show an embodiment of the invention whereby the cover can be restored to the shielding position by manual means.

Figure 8A:
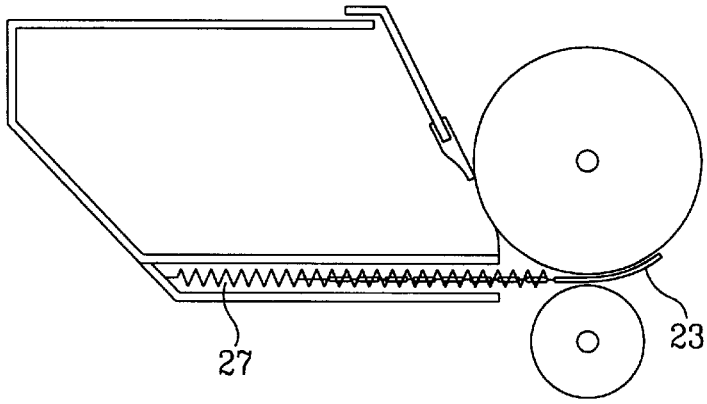
Figure 8B:
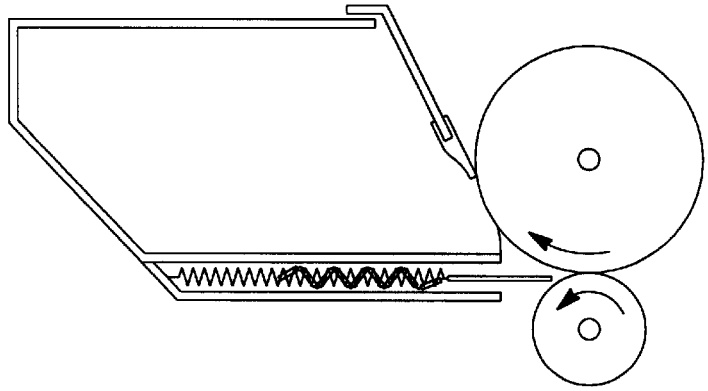

FIGS. 8A and 8B show a concertina design for the drum cover which allows the overall length to contract after opening. FIG. 8A shows the cover fully extended in a shielding position and FIG. 8B shows the retracted and contracted position.

Figure 9:
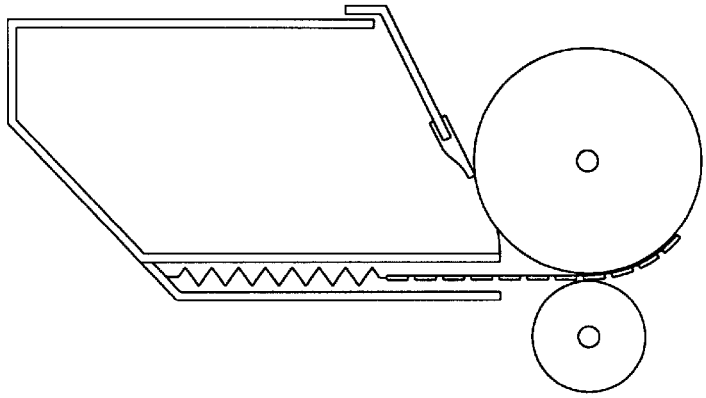

FIG. 9 shows a multi-rigid element construction allowing more protection whilst retaining flexibility.

Figure 1:
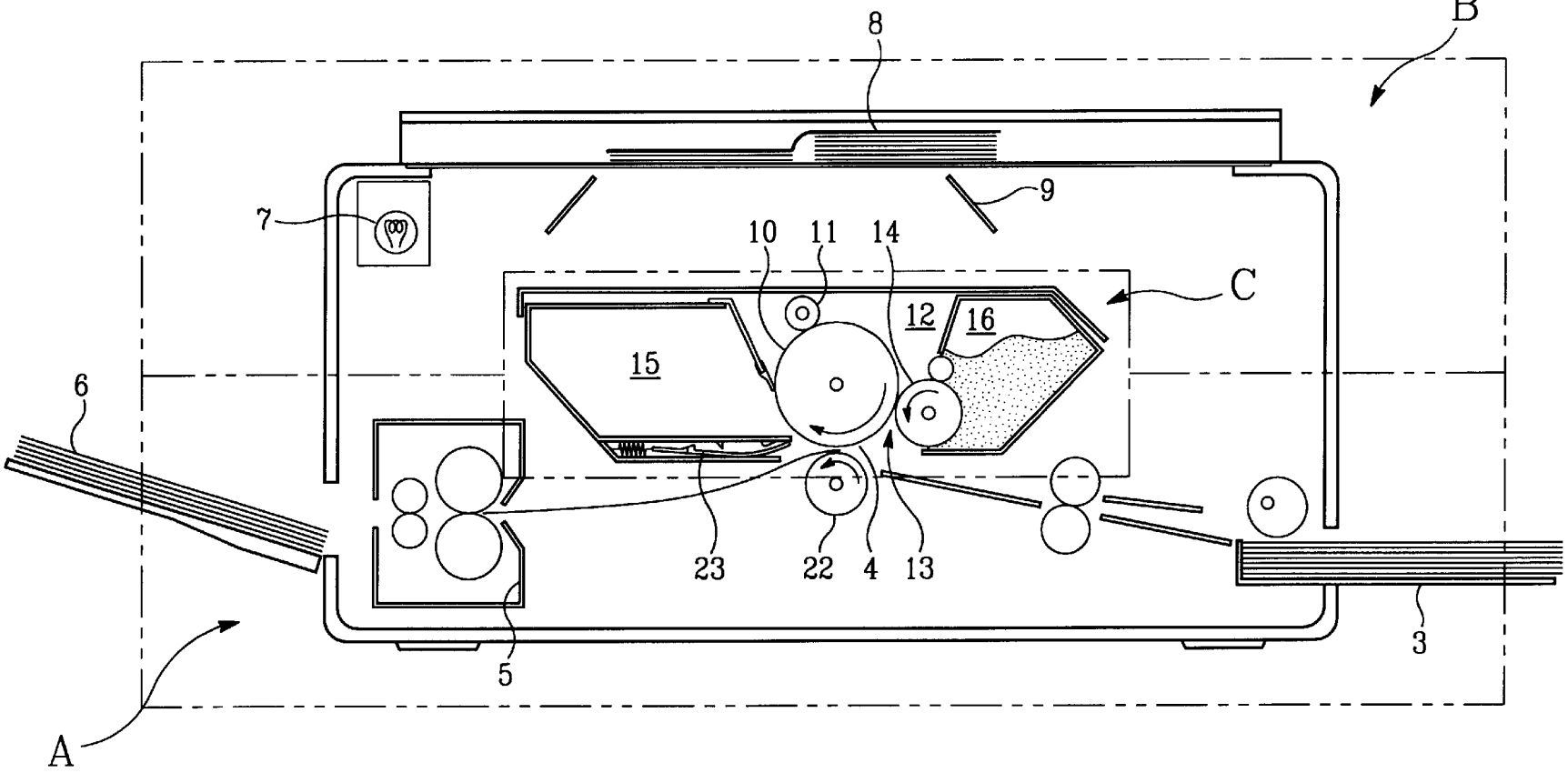
FIG. 1 shows a schematic of an image forming apparatus (electrophotographic copier) indicating those parts which may be enclosed in a process unit.

This invention relates to a process unit which forms a part of an image forming apparatus and contains process means for forming an electrophotographic image and which in normal use would be replaced by unskilled users. The image forming apparatus may be an electrophotographic copier; a laser beam printer; a fax machine; or a combination of either or all of these. The process means may comprise a magnetic brush system for transporting mono- or dual component developer from locations in one or more hoppers to a developing station whereby the developer and/or toner is presented to a latent image on the photosensitive drum. Other process means may comprise the charging mechanism for the photosensitive drum; the transfer mechanism; and/or the cleaning mechanism. With reference to FIG. 1, an image forming apparatus such as an electrophotographic copying machine can be divided into four Sections. The so-called base engine (A) comprises the paper handling mechanisms which feed the paper from a storage cassette (3) through a transfer section (4) which forms part of an image receiving section (12) to a fixing unit (5) which employs temperature and pressure to fix the image onto the receiving medium. There is then an output tray (6) to which the medium is fed. The second Section is the image forming section (B) which comprises a light source (7) illuminating an image to be copied (8), this illumination being reflected off the subject image through an optical system (9) and finally focused on to a photosensitive drum (10). The photosensitive drum is part of the third main Section which may be termed the xerographic section (C). The drum (10) is charged by a charging device (11) prior to exposure to said light image. Having rotated past the image receiving section (12) where the charged surface is selectively discharged to form an electrical version of the image (latent image) the surface of the photosensitive drum passes a development zone (13) where a layer of toner and/or developer (14) is exposed to the latent image and electrostatic and/or magnetic forces cause the toner to transfer to the surface of the drum in the pattern of the latent image. The drum rotates further to a transfer section (4) where electrical and/or electrostatic forces cause the toner to transfer to the receiving medium. Any toner or developer remaining on the drum is cleaned off at a cleaning station (15). The fourth Section (D—not shown) of such a copying device is the control electronics which comprise power supplies and controllers for supervising the various operations of the machine.

(In digital applications such as laser beam printers or digital copiers, Section B differs in that a laser beam is used to generate the light image. The beam is modulated or pulsed to form "light dots" which are scanned in a raster fashion across the photosensitive drum. Section D differs in that substantial hardware and software are dedicated to image preparation and rasterisation of the page image. Sections A and C can be very similar to the electrophotographic copier described above).

In this embodiment many of the consumable items of the machine are contained in Section C. Section C comprises a removable process unit which may be removed by the user (a) during the life of the process unit to clear paper jams or to exchange for a process unit containing toner of a different colour; or (b) when the toner powder contained in the hopper (16) is exhausted and the user either discards the process unit or (preferably) returns the process unit for recharging and refurbishing.

It is the handling of the process unit by a person who is not necessarily skilled at photocopier maintenance which necessitates a shield to protect the photosensitive drum. This protection is designed to avoid physical and light damage to the photosensitive layer on the drum during transportation, storage and unpacking; paper jam clearing and process unit exchange during the life of the process unit; and finally extraction, repacking and shipment to a remanufacturer when one of the consumables in the process unit, such as toner, becomes exhausted.

In most designs and also in the preferred embodiment of the invention, the drum cover needs to be moved in order that image transfer (section 4 in FIG. 1) can take place.

Figure 2:
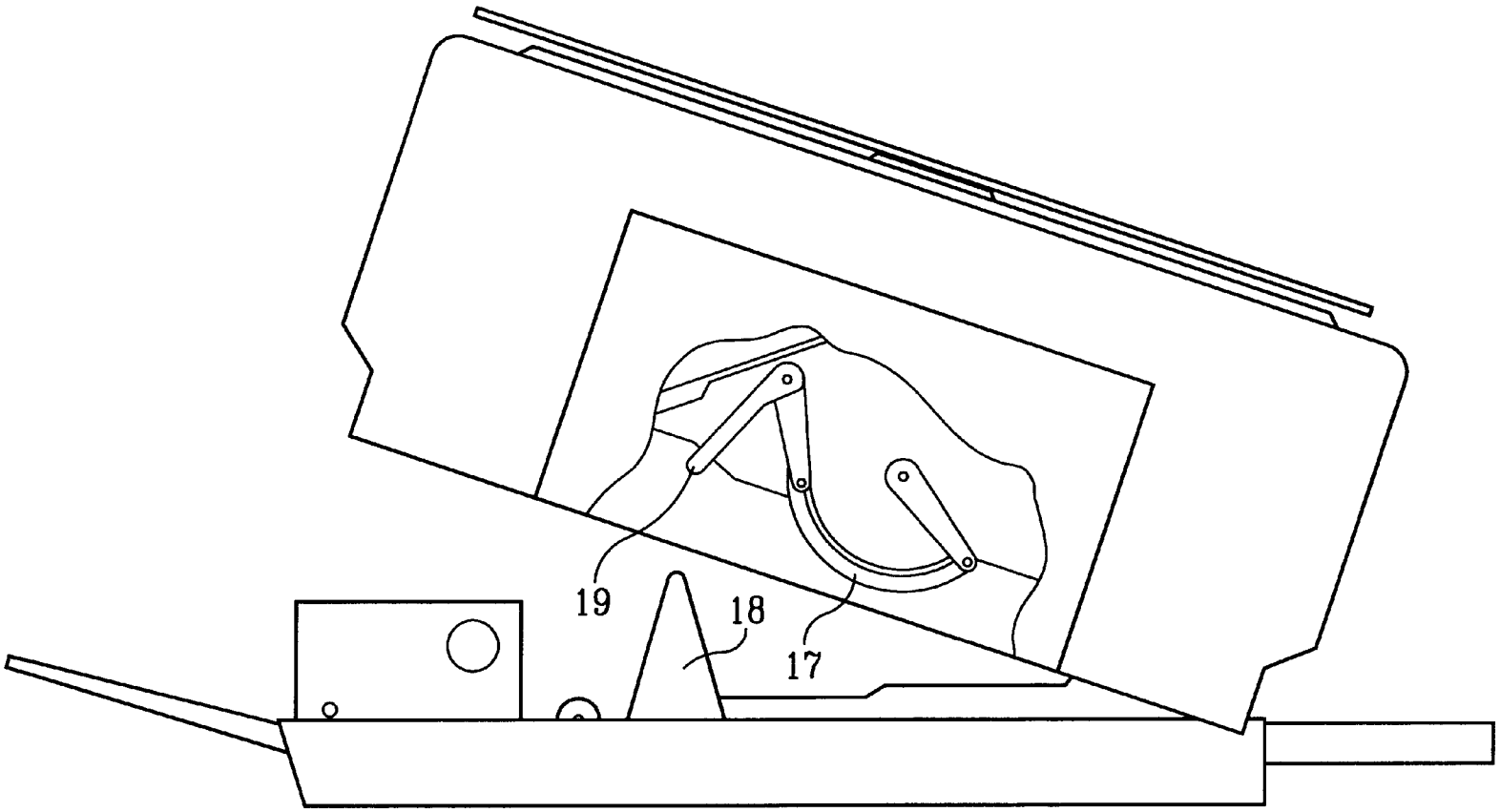
Fig. 2 Prior Art
FIG. 2 shows an image forming apparatus of a clam shell design which contains a process unit and utilises a mechanical actuator to move the drum cover when the machine is opened or closed. This forms one aspect of the prior art.

FIG. 2 shows a prior art embodiment where the drum cover (17) is normally in the closed position to shield the drum. However when the clam-shell machine is closed an actuator (18) in the base engine operates a lever (19) on the process unit which opens the cover and enables image transfer.

FIGS. 3A and 3B shows another embodiment of the prior art whereby a mechanism is provided for closing the drum cover as the process unit is removed from the machine. In this case a post (20) provided in the process unit receiving area activates a lever (33) mounted on the process unit as the process unit is inserted. This lever in turn swings the cover (21) away from the transfer station area. FIG. 3A shows the cartridge prior to installation and FIG. 3B shows the cartridge after installation.

In FIG. 3B it can be seen that after installation of the cartridge the cover has been moved away from the transfer section (4) by the actuator lever and then the photosensitive drum (10) comes into contact with the transfer roller (22). The function of the transfer roller is to feed the paper through the transfer zone (4) of the electrophotographic machine and at the same time provide an electrostatic bias which has the effect of drawing toner from the photosensitive drum (10) to the paper medium. The transfer roller is mounted on a spring (34) to ensure sound mechanical contact with the Photosensitive Drum, even allowing for variations in the installed position of the drum.

The preferred embodiment of the current invention utilises the mechanical contact between the photosensitive drum and the transfer roller such that one or both members may contact certain portions of the drum cover and move the cover when the photosensitive drum and/or the transfer roller begin to rotate. FIGS. 4A, 4B and 4C show the photosensitive drum (10); the transfer roller (22); and the drum cover (23) enclosed between. FIG. 4A shows the positions of drum (10), cover (23) and transfer roller (22) immediately after the process unit has been inserted and before a print or copy has been activated. When a print or copy is activated, the drum and transfer roller will start to rotate and drive out the cover from between them (FIG. 4B). At a certain point the cover will reach a position where it is further biased into a further retracted position, away from the paper path (FIG. 4C).

The cover (23) may be flexible or rigid and made from moulded plastic, paper, polymer or other suitable material. It would be preferably opaque in order to additionally shield the drum from stray light, but might also be transparent or semi-opaque. In the preferred embodiment the cover would be made of paper of a similar type to that which during use carries the developed image from the photosensitive drum to the fusing station. In this case the photosensitive drum is designed for contact with this medium and so no additional design considerations need be applied to the photosensitive drum coating or to the transfer roller to allow for contact with the cover.

In this embodiment, the rotation of the Photosensitive Drum (10) is the major driving force to retract the Cover (23) to a point where it is biased further into a further retracted position. However the driving force may come from the movement of any other element engaged in the image forming or transfer operation, including but not limited to the charge roller, developer roller, transfer roller or cleaning mechanism. The driving force may be friction; mechanical gearing or belt drive; electrostatic forces; or a combination of these.

FIGS. 5A and 5B show the photosensitive drum (10), the drum cover (23) and the transfer roller (22). Two pairs of spacing members (24) are attached to the drum cover in positions outside the image area (25) of the photosensitive drum. The image area (25) is that portion of the drum which contains the latent (and subsequently developed) image. The width of the image area corresponds approximately to the width of the paper medium (less unprinted margins) for which the process unit is designed. In this way damage to the photosensitive drum or transfer roller in the imaging areas can be minimised or eliminated. Such damage may be caused by friction between the materials and or trapped particles. The spacers may comprise strips of foam or other material or they may be raised portions integral to the cover itself. Preferably they should have frictional qualities which enable the cover to be effectively moved when the drum starts to rotate. The spacers can be located on the drum side, the transfer roller side or both sides of the drum cover.

FIGS. 6A, 6B and 6C show the mechanism of the preferred embodiment in three stages of cover opening. In this embodiment the drum cover has two members which can move relative to one another. These two elements perform the functions of shielding and latching and they are connected by a linkage (32). FIG. 6A shows the mechanical system at rest before initial rotation. It can be seen in FIG. 6A that a receptacle (26) is provided to house the drum cover when it withdraws from its shielding position. Springs (27) are provided to urge the cover into the retracted position. However a latch (28) locating into a recess in one element of the drum cover (31) prevents the cover from withdrawing under the influence of the springs.

FIG. 6B shows the cover (23) at the point when the drum has started to rotate and has engaged the drum cover and moved the cover from between the drum and the transfer roller. At this point in the preferred embodiment a member (29) will unlatch the cover assembly and enable it to retreat from the proximity of the drum and the transfer roller under the influence of springs (27) in order not to interfere with the transfer operation or the paper movement.

FIG. 6C shows the cover in the fully retracted position and housed within the receptacle (26). This receptacle forms part of the outer cover of the process unit and so the cover retracts to a position inside the process unit. In the preferred embodiment the cover will remain in the retracted position indefinitely. However other mechanisms can allow the cover to return into its shielding position when an imaging member stops moving.

When the process unit has been used up or if a period of storage is required the user may wish to return the drum cover to its shielding position. FIGS. 7A and 7B show tabs (30) which may be used to manually return the cover to its shielding position. An internal member (not shown) guides the cover back onto the latch. FIG. 7A shows the process unit prior to manual closing of the cover and FIG. 7B shows the cover restored to the shielding position.

FIGS. 8A and 8B show a cover of a concertina design which also contracts in overall size as it retracts. FIG. 8A shows the cover (23) in the engaged position with a portion of the cover effectively stretched. The biasing springs (27) are attached on the drum side of the stretched portion. When the cover disengages from between the drum and transfer roller the biasing springs cause the concertina to contract.

FIG. 9 shows a multi slat cover mechanism which enables a flexible design but with more substantial protection for the Photosensitive Drum. The slats are mutually hinged.

What is claimed is:

1. An electrophotographic image forming apparatus comprising:

a removably mounted process unit containing a photosensitive member and process means;

a movable cover connected to the process unit and shielding an area of the periphery of the photosensitive member;

arranged such that the movable cover is caused to retract from its shielding position in response to rotational movement of the photosensitive member.

2. An electrophotographic image forming apparatus according to claim 1 where said cover comprises a paper portion adjacent to the image area of the photosensitive member.

3. An electrophotographic image forming apparatus according to claim 1 where contact elements on said cover are provided in positions outside of the corresponding image area on the photosensitive member.

4. An electrophotographic image forming apparatus according to claim 1 where said cover comprises two or more sections which move relative to one another when the cover is caused to retract from the shielding position.

5. An electrophotographic image forming apparatus according to claim 1 where biasing means are provided to further move the cover once the cover has been initially driven by the movement of the photosensitive member.

6. A process unit for use in an electrophotographic image forming apparatus comprising:

a photosensitive member;

process means;

a movable cover connected to the process unit and shielding an area of the periphery of the photosensitive member;

arranged such that when the process unit is installed in an image forming apparatus the movable cover is caused to retract from its shielding position in response to rotational movement of the photosensitive member.

7. A process unit according to claim 6 where said cover comprises a paper portion adjacent to the image area of the photosensitive member.

8. A process unit according to claim 6 where contact elements on said cover are provided in positions outside of the corresponding image area on the photosensitive member.

9. A process unit according to claim 6 where said cover comprises two or more sections which move relative to one another when the cover is caused to retract from the shielding position.

10. A process unit according to claim 6 where biasing means are provided to further move the cover once the cover has been initially driven by the movement of the photosensitive member.

11. A process unit for use in an electrophotographic image forming apparatus comprising:

a photosensitive member;

process means, a movable cover connected to the process unit and shielding an area of the periphery of the photosensitive member;

arranged such that when the cover is caused to retract from its shielding position, it is housed within the peripheral walls of the process unit, wherein said cover comprises a paper portion.

12. A process unit for use in an electrophotographic image forming apparatus comprising:

a photosensitive member;

process means;

a movable cover connected to the process unit and shielding an area of the periphery of the photosensitive member;

arranged such that when the cover is caused to retract from its shielding position it is housed within the peripheral walls of the process unit, wherein spacing elements on said cover are provided in positions outside of the corresponding image area on the photosensitive member.

13. A process unit for use in an electrophotographic image forming apparatus comprising:

a photosensitive member;

process means;

a movable cover connected to the process unit and shielding an area of the periphery of the photosensitive member;

arranged such that when the cover is caused to retract from its shielding position it is housed within the peripheral walls of the process unit, wherein said cover comprises two or more sections which move relative to one another when the cover is caused to retract from the shielding position.

14. An electrophotographic image forming apparatus comprising:

a removably mounted process unit containing a photosensitive member and other process means;

a movable cover connected to the process unit and shielding an area of the periphery of the photosensitive member;

arranged such that the movable cover is caused to retract from its shielding position in response to movement of an element involved in the imaging, transfer or cleaning operations of the process unit.

15. An electrophotographic image forming apparatus according to claim 14 where biasing means are provided to further move the cover once the cover has been initially driven by the movement of said element involved in the imaging, transfer or cleaning operations of the process unit.

16. An electrophotographic image forming apparatus according to claim 11 where said cover comprises a paper portion adjacent to the image area of the photosensitive member.

17. An electrophotographic image forming apparatus according to claim 11 where contact elements on said cover are provided in positions outside of the corresponding image area on the photosensitive member.

18. An electrophotographic image forming apparatus according to claim 11 where said cover comprises two or more sections which move relative to one another when the cover is caused to retract from the shielding position.

19. A process unit for use in an electrophotographic image forming apparatus comprising:

a photosensitive member;

process means having one or more process members involved in the imaging, transfer or cleaning operations of the process unit;

a movable cover connected to the process unit and shielding an area of the periphery of the photosensitive member;

arranged such that when the process unit is installed in an image forming apparatus the movable cover is caused to retract from its shielding position in response to movement of at least one of the one or more process members involved in the imaging, transfer or cleaning operations of the process unit.

20. A process unit according to claim 19 where biasing means are provided to further move the cover once the cover has been initially driven by the movement of at least one of the one or more process members.

21. A process unit according to claim 19 where said cover comprises a paper portion adjacent to the image area of the photosensitive member.

22. A process unit according to claim 19 where contact elements on said cover are provided in positions outside of the corresponding image area on the photosensitive member.

23. A process unit according to claim 19 where said cover comprises two or more sections which move relative to one another when the cover is caused to retract from the shielding position.

* * * * *